United States Patent [19]

Takimoto et al.

[11] Patent Number: 4,679,414

[45] Date of Patent: Jul. 14, 1987

[54] APPARATUS FOR CONTROLLING A DEWATERING PROCESS

[75] Inventors: Kazutoshi Takimoto, Yao; Takatomo Matsumi, Fujiidera; Koji Kikuchi, Osaka, all of Japan

[73] Assignee: Sharp Kabushiki Kaisha, Osaka, Japan

[21] Appl. No.: 790,347

[22] Filed: Oct. 23, 1985

[30] Foreign Application Priority Data

Jan. 18, 1985 [JP] Japan ..... 60-7861
Feb. 6, 1985 [JP] Japan ..... 60-22199

[51] Int. Cl.[4] ..... D06F 33/02
[52] U.S. Cl. ..... 68/12 R
[58] Field of Search ..... 68/12 R, 23 R; 210/739, 210/85, 143

[56] References Cited

U.S. PATENT DOCUMENTS 4,517,695 5/1985 Hoffmann et al. ..... 68/12 R X

FOREIGN PATENT DOCUMENTS 71777 4/1984 Japan ..... 68/12 R

*Primary Examiner*—Philip R. Coe
*Attorney, Agent, or Firm*—Flehr, Hohbach, Test, Albritton & Herbert

[57] ABSTRACT

Dewatering process in the operation of a totally automated washing machine, centrifugal dewaterer and the like is controlled by monitoring the dewatering rate to determine whether the initial instability period due to motor vibrations, etc. has past. The time to terminate the process is computed on the basis of timer reading at the end of such instability period and this information is kept and utilized later even if the operation is interrupted and restarted during a process so as to prevent errors in estimating the time to terminate the dewatering process.

1 Claim, 12 Drawing Figures

APPARATUS FOR CONTROLLING A DEWATERING PROCESS

This invention relates generally to apparatus for controlling a dewatering process in the operation of a totally automated washing machine, a centrifugal dewaterer and the like.

Means for controlling a dewatering process (such as a spin cycle in the operation of a washing machine) generally include a detector which outputs a special kind of signal when the rate of water ejected from a dewatering tank reaches a predetermined level and the time to terminate the dewatering process is determined on the basis of this signal. At the beginning of a dewatering process, however, there is a period in which such output signals are unstable due to the motor vibrations, etc. In order to eliminate the undesirable effects of such instabilities, a no-response period of a predetermined duration is usually defined and it is only after this no-response period that signals outputted from the detector are checked to determined if they are of a specified kind. If it is determined that a signal of a specified kind is outputted, the time at which the detector stops outputting signals of this kind is determined and this information is used to compute the time at which the dewatering process is terminated. When the articles inside the dewatering tank are not evenly balanced, however, the dewatering process may not proceed smoothly for a long time. The output signals from the detector in such a situation may remain unstable even after the initial no-response period and this may cause incorrect determination of the time to terminate the dewatering process. If the no-response period is too long, on the other hand, signals of the specified type may be interrupted before the end of the no-response period. This may happen, for example, when the dewatering tank is not very full.

The detector is adapted to determine the point in time at which the dewatering rate decreases and to compute the time to terminate the dewatering operation on the basis of the time elapsed from the beginning of the dewatering process up to the aforementioned point in time. Control means of this type, however, are adapted to interrupt the dewatering operation for the sake of safety whenever the lid of the dewatering tank is opened. When this happens, the control data collected up to such a moment are generally erased and the control returns to its initial conditions. When the lid is subsequently closed again and the dewatering operation is resumed, the time to terminate the dewatering process is thereafter controlled on the basis of data collected only after the time of restarting the operation. If the lid is temporarily opened and the operation is subsequently restarted before the aforementioned moment at which the rate of dewatering would change from fast to slow, the rate of dewatering will decrease only shortly after the operation is restarted. If this short period of time is used to compute the time to terminate the dewatering operation, the result will be incorrect, giving too short a time compared to the period which would actually be required for proper dewatering (about three times the duration between the starting time of the dewatering process and the aforementioned moment when the rate of dewatering changes from fast to slow). If the lid is temporarily opened and the operation is restarted after the rate of dewatering changes from fast to slow, on the other hand, there will be no change in the rate of dewatering from fast to slow thereafter and the computation of the time to terminate the dewatering process will have to be carried out on the basis of a predetermined default value.

It is therefore an object of the present invention in view of the above to provide an apparatus for controlling a dewatering process which can correctly function independently of uneven distribution of articles being dewatered in a tank.

Another object of the present invention is to provide an apparatus for controlling a dewatering process by means of which the time to terminate the process can be correctly computed even if the process is interrupted and restarted.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

According to the present invention, a dewatering process is controlled by monitoring the rate of dewatering to determine when the initial instability period due to motor vibrations and the like has passed, this making it possible to identify a reliable initial value from which the time to terminate the process can be correctly computed. Moreover, the dewatering data being outputted during a process are not erased even when the process is interrupted and then restarted. This also prevents errors in estimating the time to terminate the dewatering process.

The accompanying drawings, which are incorporated in and form a part of the specification, illustrate embodiments of the present invention and, together with the description, serve to explain the principles of the invention.

Figure 1:
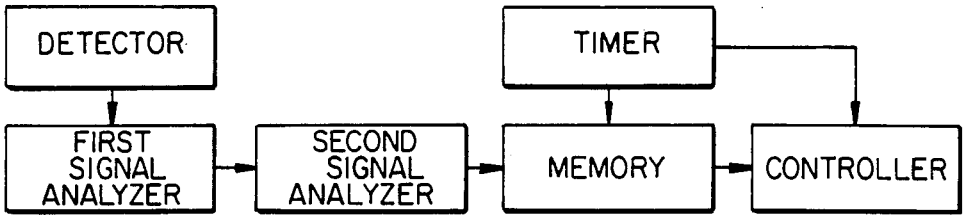
FIG. 1 is a schematic diagram for showing the structure of the present invention.

As shown in FIG. 1, an apparatus for automatically controlling a dewatering operation according to the present invention comprises a detector which serves to output a signal corresponding to the amount of water ejected from a dewatering tank, a first signal-analyzing means (comparator) for determining whether an output signal from the detector is of a predefined kind, a second signal-analyzing means (comparator) for repeatedly determining, when the first signal-analyzing means determines that an output signal from the detector is of the predefined kind, whether a signal of this predefined kind has continued for a fixed length of time, a timer for counting time from the beginning of a dewatering operation, a memory means which serves to read and store the time information from the beginning of the dewatering operation when said second signal-analyzing means decides that a signal of the predefined kind has continued for the fixed length of time and also to update such stored time information every time it is determined that a signal of the predefined type has continued for the specified length of time, and a controller means for controlling the termination of the dewatering operation on the basis of the time information stored in the memory means a specified time interval after the beginning of the dewatering operation.

In another aspect of the present invention, a method for controlling a dewatering process is provided whereby dewatering control data are not erased but retained when the lid of the dewatering tank is opened temporarily and then closed again to resume the dewatering operation. Such retained data are compared with the data obtained after the operation is restarted and the time to terminate the dewatering operation is computed on the basis of the result of such comparison. Thus, the control means includes a means for detecting whether the lid of the dewatering tank is open or closed which is adapted to output an OPEN signal or a CLOSE signal, depending on whether the lid is opened or closed, restarting means serving to retain data up to the moment when the lid is opened during a dewatering process and to restart the dewatering operation in response to a CLOSE signal from the aforementioned detecting means and comparator means for comparing data after the restarting of the operation and before the lid was open. The time to terminate the dewatering operation is controlled by the results of such comparison performed by this comparator means. According to the embodiment explained herein, the amount (rate) of water ejected out of the dewatering tank is used as control data.

Figure 2:
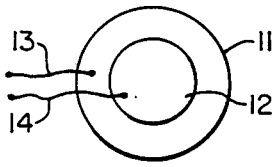
FIGS. 2 and 3 are respectively a front view and a side view of a principal part of a dewatering sensor.
Figure 3:
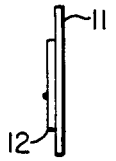

FIGS. 2 and 3 are respectively a front view and a side view of a principal part of a dewatering sensor. Numeral 12 indicates a ceramic piezoelectric element having electrodes formed on both of its surfaces and numeral 11 indicates a metallic vibratory plate pasted on one of the electrode surfaces of the piezoelectric element 12 in an electrically conductive relationship therewith. Numerals 13 and 14 indicate electrode terminals.

Figure 4:
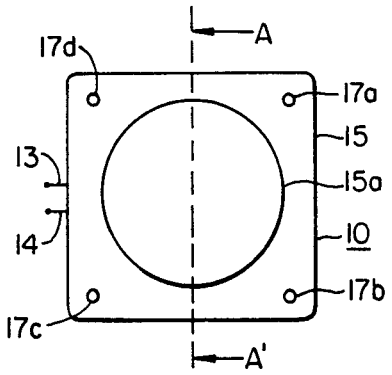
FIG. 4 is an external front view of a dewatering sensor including the part shown in FIGS. 2 and 3.
Figure 5:
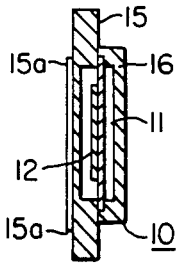
FIG. 5 is a cross-sectional view of the dewatering sensor of FIG. 4 taken along the broken line therein in the direction of the arrows A and A'.

FIG. 4 is an external front view of the dewatering sensor 10, of which a part was shown in FIGS. 2 and 3. Numeral 15 indicates an electrically insulative piece having a protruding circular center section 15*a* and attachment holes 17*a–d*. FIG. 5 is a cross-sectional view of the dewatering sensor 10 of FIG. 4 seen along the broken line therein in the direction of the arrows A an A', showing the piezoelectric element 12 and the metallic vibratory plate 11 of FIGS. 2 and 3 vibratably secured by an electrically insulative casing composed of pieces 15 and 16.

Figure 6:
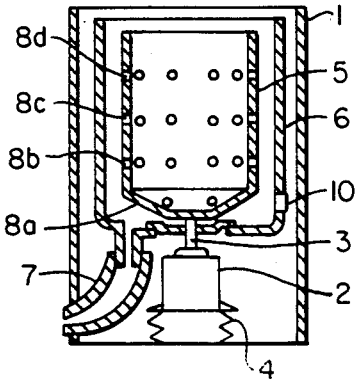
FIG. 6 is a cross-sectional view of a part of a dewatering apparatus into which the sensor of FIGS. 4 and 5 is incorporated as a component.

FIG. 6 is a cross-sectional view of a part of a dewatering apparatus into which the sensor 10 of FIGS. 4 and 5 is incorporated as a component. A motor 2 for driving a dewatering tank 5 is attached to a housing 1 through buffering means 4 such as springs. The dewatering tank 5 is connected to the motor 2 by way of a shaft 3. A container 6 is disposed envelopingly opposite the external peripheral surface of the dewatering tank 5 and a drain pipe 7 is connected to its bottom surface. The dewatering tank 5 is provided with many holes 8*a–d* for liquid to pass through, and the dewatering sensor 10 is secured so as to be in a face-to-face relationship with a plurality of (such as 9) bottom-level holes 8*a* opening at the lower part of the dewatering tank 5.

Figure 7:
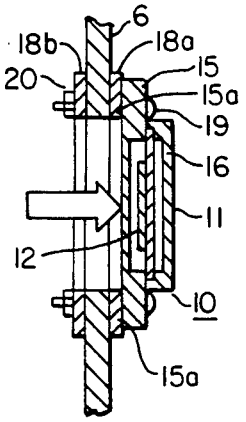
FIG. 7 is an enlarged cross-sectional view showing how the dewatering sensor of FIGS. 4 and 5 is attached to the dewatering apparatus of FIG. 6.

FIG. 7 is an enlarged cross-sectional view showing how the dewatering sensor 10 is attached to the dewatering apparatus of FIG. 6. The piece 15 is tightly affixed through a packing 18*a* to the container 6 by bolts 19 and nuts 20 such that it tightly fits into an opening created in the container body. The protruding center section 15*a* of the piece 15 indents the packing 18*a*. Numeral 18*b* also indicates a packing and the arrow shows how water drops hit the sensor 10.

Figure 8:
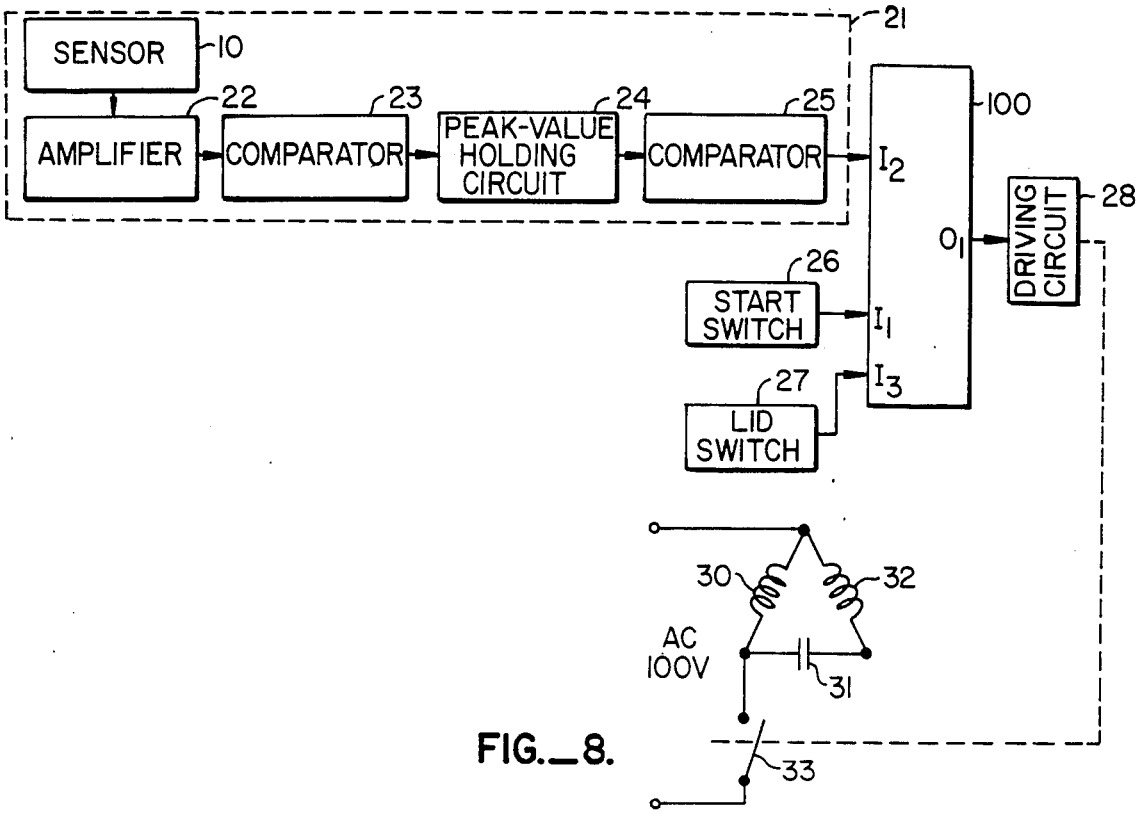
FIG. 8 is a block diagram of a principal part of an electronic control circuit for controlling a dewatering process.

FIG. 8 is a block diagram of a principal part of an electronic control circuit for controlling a dewatering process. A detector section 21, of which the dewatering sensor 10 is a part, also includes an amplifier circuit 22 for amplifying the output voltage from the dewatering sensor 10, a first comparator circuit 23, a peak-value holding circuit 24 and a second comparator circuit 25. The first comparator circuit 23 is for eliminating small output voltages from the dewatering sensor 10 and serves to compare the output voltages from the dewatering sensor 10 with a fixed voltage and to make an output only when the voltage is greater than this fixed voltage value. The peak-value holding circuit 24 is adapted to generate an output of a long time duration when it receives a signal (usually of a short duration each time) from the first comparator circuit 23. The second comparator circuit 25 is adapted to output a LOW (L) signal or a HIGH (H) signal, depending on if the output from the peak-value holding circuit 24 exceeds a specified voltage or not.

Figure 9:
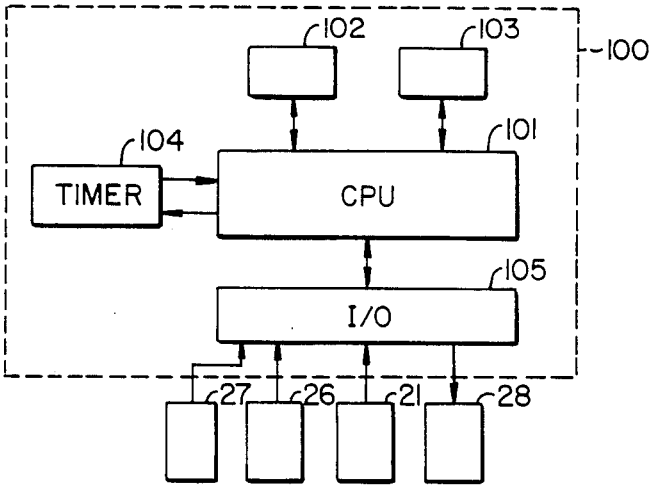
FIG. 9 is a block diagram for showing the internal structure of the controller section of FIG. 8 and its relationship with external circuits.

FIG. 8 also shows a start switch 26 for starting the dewatering process and a controller section 100 including a microcomputer. The internal structure of the controller section 100 and its relationship with external circuits are shown in FIG. 9 wherein numeral 101 indicates a central processing unit (CPU), numeral 102 indicates read-only memory (ROM) means for storing programs and fixed data, numeral 103 indicates random access memory (RAM) means for temporary storage, numeral 104 indicates a timer and numeral 105 indicates an input/output (I/O) unit. Numeral 27 indicates a lid switch corresponding to the opening and closing of a lid of the dewatering tank. Numeral 28 indicates a driving circuit for switching on and off the motor 2 according to an output from the controller section 100. According to the embodiment illustrated in FIG. 8, a relay is provided to the driving circuit 28 and numeral 33 indicates its junction point. Numerals 30 and 32 indicate coils for the motor 2 and numeral 31 is a capacitor.

Figure 10:
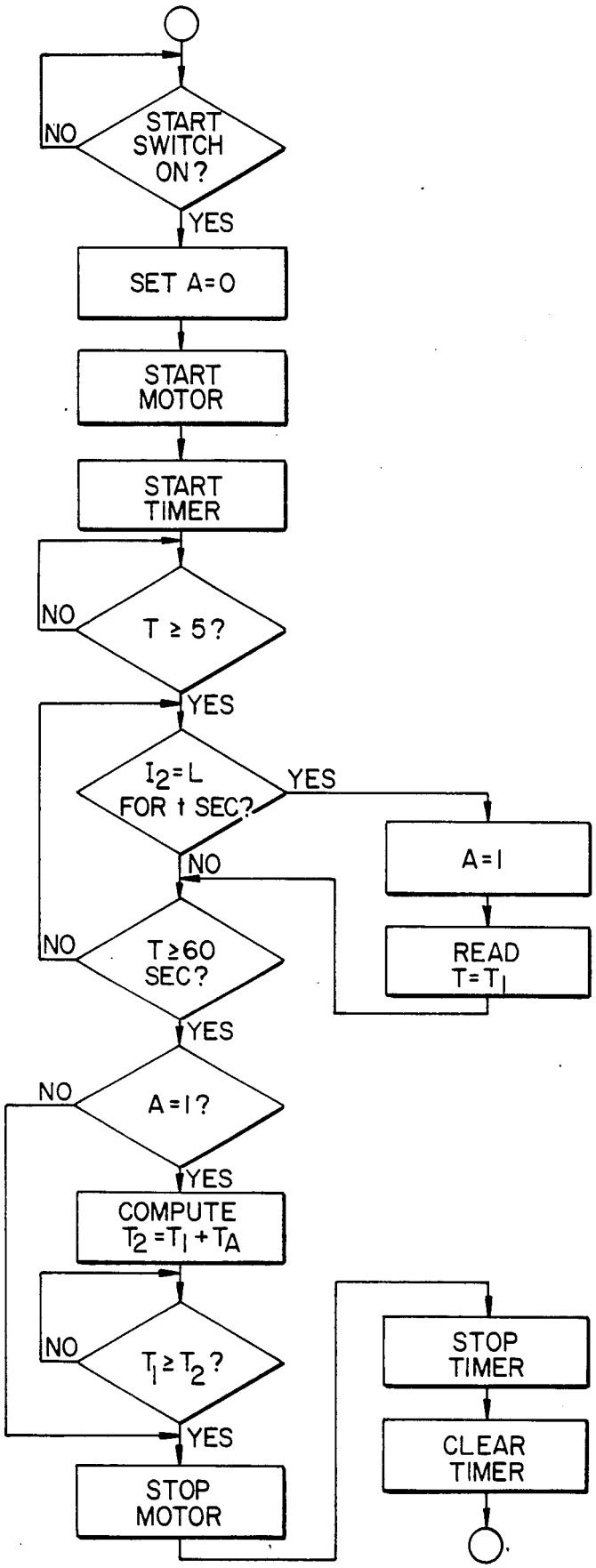
FIG. 10 is a flow chart of a routine for controlling a dewatering operation according to an embodiment of the present invention.

Next, a routine for controlling a dewatering operation according to an embodiment of the present invention is explained by way of a flow chart shown in FIG. 10. First, the start switch 26 is turned on, causing an L signal to be transmitted as input signal $I_1$ (referring to FIG. 8). When this signal is received, a flag A is set to zero as initialization step and an H signal is transmitted as output signal $O_1$ to activate the driving circuit 28 to drive the motor 2 and to start the timer 104. As explained above, the input signal from the detector section 21 is usually unstable when the motor 2 is started. For this reason, an initial period of five seconds is set aside as a no-response period according to this embodiment. When the timer reading T reaches five seconds, the processing unit 101 begins to check whether the input signal $I_2$ from the detector section 21 is L or H. If it is found to be L, it is then determined whether this signal continues for a fixed time duration t (such as one second). If it is found to have continued for this time duration, the flag A is switched to 1 and the timer reading $T_1$ at this time is read and stored. This step of checking whether $I_2$ is L and, if so, whether it lasts for a duration of t is repeated, for example, until the timer reading reaches 60 seconds. During this time (60 seconds), the timer reading $T_1$ is updated each time it is found that $I_2$ is L and that this condition has lasted for a duration of t. If $I_2$ is not L when the timer reading T reaches 5 seconds for the first time, the aforementioned step is repeated until the timer reading T reaches 60 seconds. The flag A is set to 1 when it is found that $I_2$ is L and that this condition has lasted for a duration of t and the timer reading at such time $T_1$ is updated each time.

The flag A is examined when the timer reading T reaches 60 seconds. If A is not 1 at this time, it is interpreted that an abnormal condition exists such that the motor 2 is not rotating normally. The motor 2 and the timer 104 are then stopped, and the timer reading becoming reset (cleared). If A is 1, on the other hand, it is interpreted that the initial period of instability has passed and the time $T_2$ for terminating the dewatering is computed by using the stored value of $T_1$ according to the formula $T_2=T_1+T_A$ where $T_A$ is a time interval which should be experimentally predetermined on the basis of the total time of dewatering required for a satisfactory result. Thereafter, the timer reading T is monitored and an L signal is outputted as $O_1$ when T reaches $T_2$ because dewatering is then deemed to have been completed. This causes the driving circuit 28 to stop the motor 2 and the timer 104 and to clear the timer reading.

Figure 11:
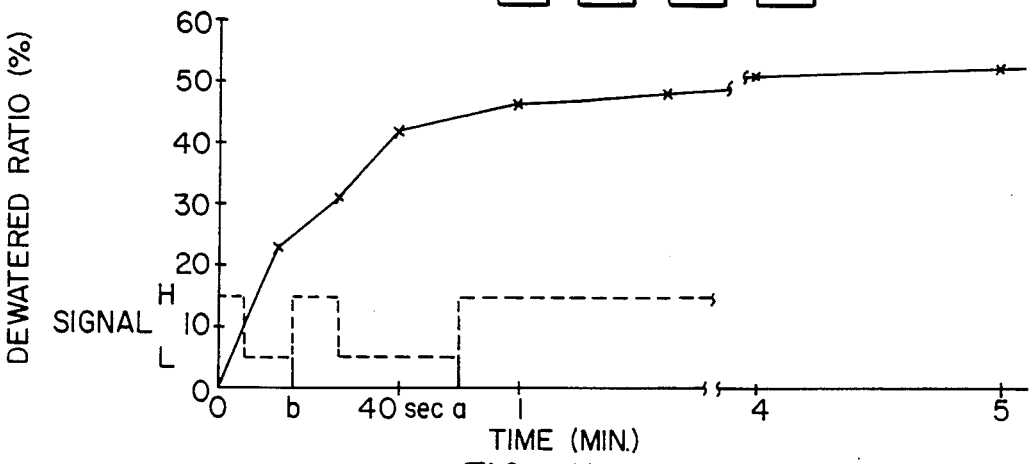
FIG. 11 is a graph showing the change in time of dewatered ratio.

FIG. 11 is a graph showing the changes in dewatered ratio when an article representing the maximum capacity (cotton cloth of mass 3 kg) is loaded in an unbalanced condition and dewatered. Dewatered ratio is herein defined by the following formula:

$$\text{Dewatered Ratio}=100[1-(W-W_0)/W_0]$$

where W is the weight of the cloth containing water and $W_0$ is the weight of the cloth after it has been naturally dried. Changes in the output from the detector section 21 is also shown. When the motor 2 is started initially, the imbalance inside the dewatering tank impedes its normal rotation but the dewatered ratio changes rapidly because the cloth contains a large amount of water. When the amount of water still contained in the cloth is reduced to a certain level, the change in the dewatered ratio becomes somewhat slower because the tank is still unbalanced and hence the motor 2 has not reached its normal operating speed. As time goes by, when the motor 2 reaches its normal operating speed, the dewatered ratio begins to change rapidly again. Still later, when the dewatered ratio reaches a certain level, the rate of its change becomes slow again. In other words, the rate of change is large to start with, becomes temporarily slow, increases again and gradually slows down.

In the meantime, the output signal from the detector section 21 changes as shown by the dotted line. The detector section 21 outputs an H signal at the beginning of a dewatering process before water particles begin to collide with the sensor 10. As soon as water particles from the dewatering tank 5 begin to impinge upon the sensor 10, the H signal changes to an L signal. When the rate of collisions suddenly drops so that the number and strength of water drops hitting the sensor 10 diminish, an H signal replaces the L signal again. In this example illustrated in FIG. 11, the signal becomes L at two times. The step of examining whether $I_2$ is L and, if so, whether this condition has lasted for a duration of t is repeated as explained above. By the example of FIG. 11, the point a in time represents the moment at which the last updated timer reading $T_1$ is read for the computation of the time for terminating the dewatering process. Before this invention, the point in time at which the L signal is first interrupted (b in FIG. 11) was used to read the timer reading for computing the time to terminate the dewatering process. FIG. 11 clearly shows that the present invention succeeds in avoiding premature termination of dewatering process.

In the example explained above, the determination whether $I_2$ is L and, if so, whether this condition has lasted for a duration of t is repeated for a period of 60 seconds. This period was so chosen because the rate of change in dewatered ratio becomes slow in less than 60 seconds as shown in FIG. 11 even if the articles to be dewatered are initially loaded in an unbalanced condition. By setting this period to be 60 seconds, it is possible to correctly identify the moment when the aforementioned rate finally changes from fast to slow. This choice and the choice of 5 seconds made earlier as the no-response period, however, are not intended to limit the present invention. They may be appropriately changed, depending on the maximum capacity of the dewatering tank, etc. The reason for checking whether the condition $I_2$ is L and whether this condition has lasted for a preset time interval (t=5 seconds by the above example) is to prevent false judgements due to instantaneous signals such as noises.

Figure 12:
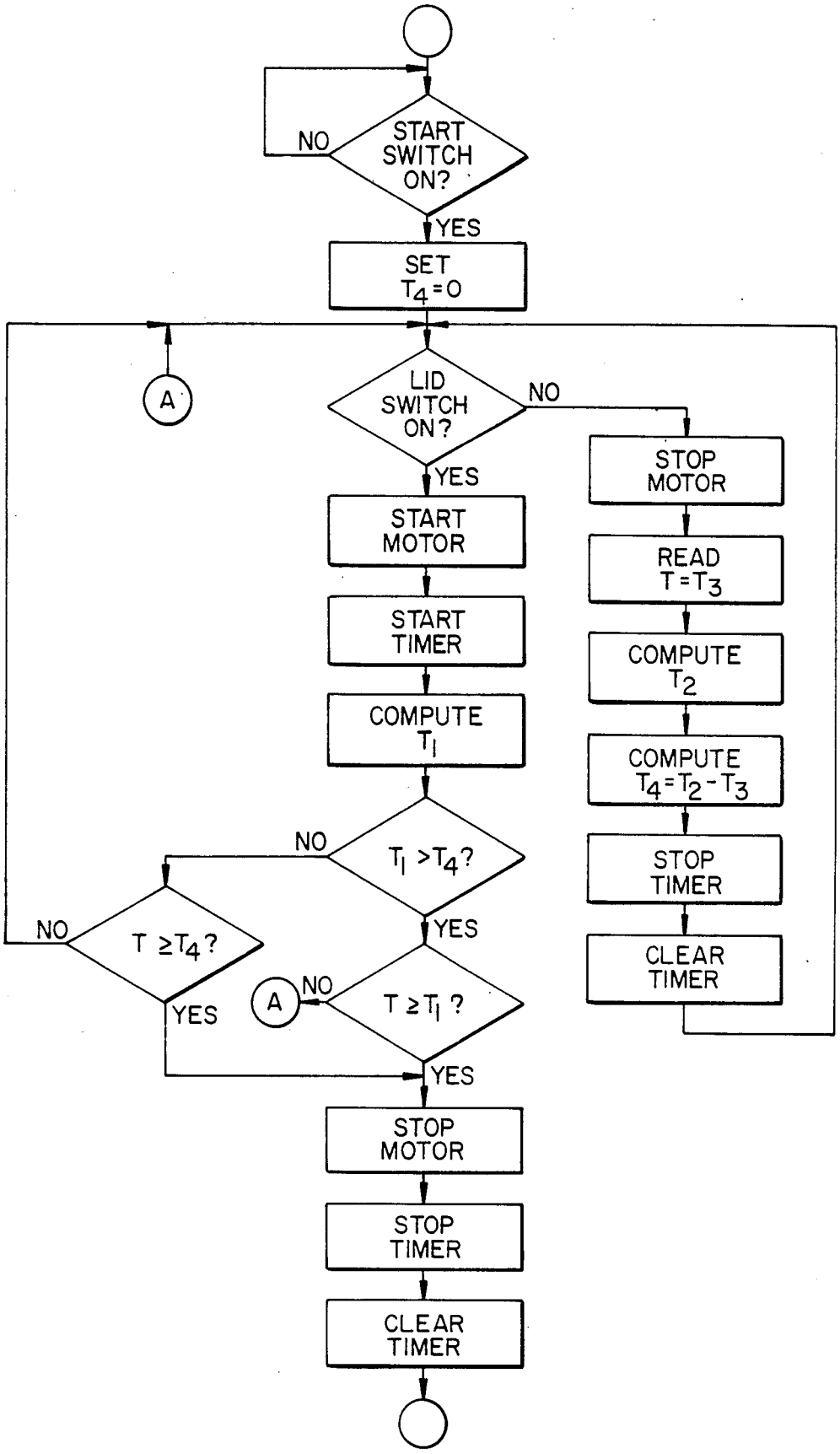
FIG. 12 is a flow chart of a routine for controlling a dewatering operation including situations where the operation is interrupted and restarted during a process.

For the sake of simplicity, the flow chart of FIG. 10 did not include the aspect of the present invention related to situations where the lid of the dewatering tank may be opened during a dewatering process and then restarted, for example, after an extra batch of articles is thrown into the dewatering tank. FIG. 12 is a flow chart of dewatering control showing this aspect of the present invention. Reference being made now to FIG. 12, the program is initialized by setting $T_4=0$ after an input of L signal informs that the start switch 26 has been switched on. Thereafter, if it is found that the lid switch 27 is in an ON condition, an H signal is transmitted as output signal $O_1$ and the dewatering process is started by starting the motor 2 and the timer 104. If the lid switch 27 thereafter remains in the ON condition and hence the lid remains closed, the program is essentially the same as shown in FIG. 10. If the lid is opened during a dewatering operation, however, the OFF condition of the lid switch 27 is detected and the motor 2 is stopped to interrupt the dewatering process. The timer reading T at this moment ($T_3$) is read and the time $T_2$ to terminate the dewatering process as well as the time $T_4$ remaining until this termination time ($T_4 = T_2 - T_3$) are computed as explained above in connection with FIG. 10. Thereafter, the timer 104 is stopped and the timer reading is cleared and the controller waits until the lid switch 27 is turned to the ON condition again. When the lid is closed and the lid switch 27 is turned on, the motor 2 and the timer 104 are started as before. The time $T_1$ to terminate the dewatering process is calculated again on the basis of the input from the detector section 21 in the same way as explained above.

In the next step, $T_4$ and $T_1$ or the data before and after the restarting are compared, and the dewatering process is continued until the timer reading T reaches the greater of the two. At the end, the motor 2 and the timer 104 are stopped and the timer reading is cleared.

In summary, the present invention discloses apparatus and method for controlling a dewatering process capable of correctly determining the time to terminate the operation even if the articles to be dewatered are loaded in an unbalanced condition in the dewatering tank or if the operation is interrupted and restarted during a process. The foregoing description of a preferred embodiment of the invention has been presented for purposes of illustration and description. It is not intended to be exhaustive or to limit the invention to the precise form disclosed, and obviously many modifications and variations are possible in light of the above teaching. For example, the dewatering sensor need not be of piezoelectric type but may comprise a light-emitting element and a light-receiving element adapted to detect the rate of water flow optically. The embodiment was chosen and described in order to best explain the principles of the invention and its practical application to thereby enable others skilled in the art to best utilize the invention in various embodiments and with various modifications as are suited to the particular use contemplated.

What is claimed is:

1. An apparatus for dewatering control comprising a detector serving to output a signal corresponding to the rate of water ejected from a dewatering tank, a first signal-analyzing means for determining whether an output signal from said detector is of a specified kind or not, a second signal-analyzing means for repeatedly determining, when said output signal is determined to be of said specific kind by said first signal-analyzing means, whether a signal of said specified kind has continued for a fixed time duration or not, a timer serving to count time from the beginning of a dewatering operation, a memory means serving to read and store a time datum from said timer when said second signal-analyzing means determines that signal of said specified kind has continued for said fixed time duration and to update said time datum every time it is determined that a signal of said specified type has continued for said specified time duration, and a controlling means for controlling the termination of dewatering operation on the basis of time datum stored in said memory means a specified time interval after the beginning of said dewatering operation.

* * * * *